US006895605B2

(12) United States Patent
Pagani

(10) Patent No.: US 6,895,605 B2
(45) Date of Patent: May 24, 2005

(54) LIQUID ACTIVE SUBSTANCE DISPENSER FOR W.C. BOWL

(75) Inventor: Fabio Pagani, Gazoldo Degli Ippoliti (IT)

(73) Assignee: RE.LE.VI. S.P.A., Rodigo (IT)

( * ) Notice: Subject to any disclaimer, the term of this patent is extended or adjusted under 35 U.S.C. 154(b) by 0 days.

(21) Appl. No.: 10/496,959

(22) PCT Filed: Oct. 21, 2002

(86) PCT No.: PCT/EP02/11765

§ 371 (c)(1),
(2), (4) Date: May 27, 2004

(87) PCT Pub. No.: WO03/048466

PCT Pub. Date: Jun. 12, 2003

(65) Prior Publication Data

US 2005/0028256 A1 Feb. 10, 2005

(30) Foreign Application Priority Data

Dec. 5, 2001 (IT) ..... RE2001A000116

(51) Int. Cl.[7] ..... E03D 9/02
(52) U.S. Cl. ..... 4/231; 4/223
(58) Field of Search ..... 4/222, 223, 224, 4/231; 222/185.1

(56) References Cited

U.S. PATENT DOCUMENTS 1,293,407 A * 2/1919 Goodhue ..... 4/223
2,075,266 A * 3/1937 Bowman ..... 4/224
6,691,329 B2 * 2/2004 Slade ..... 4/231

FOREIGN PATENT DOCUMENTS

| | | |
|---|---|---|
| DE | 199 15 322 | 1/2001 |
| EP | 0 538 957 | 4/1993 |
| EP | 0 878 586 | 11/1998 |
| EP | 1 046 756 | 10/2000 |
| GB | 2 338 498 | 12/1999 |
| WO | WO 01/04428 | 1/2001 |
| WO | WO 01/32995 | 5/2001 |
| WO | WO 01/44590 | 6/2001 |

* cited by examiner

*Primary Examiner*—Tuan Nguyen
(74) *Attorney, Agent, or Firm*—Browdy and Neimark, P.L.L.C.

(57) ABSTRACT

The dispenser comprises a bottle (11) for containing the active substance (R) in the liquid state and provided with an exit mouth (12) for the active substance (R), and a support means (20) for supporting said bottle (11) in an inverted position, in a position subjected to the action of the flushing water flow. The support means (20 comprises, for containing the active substance, a reservoir (21) located in a position subjected to the action of the flushing water flow and arranged to receive the mouth (12) of the bottle, and a member (30) positioned in said containing reservoir (21) to close the mouth (12) of the bottle (11); there is also provided for the active substance at least one passageway associated with said closure member (30) to enable the active substance to pass from the internal chamber of the bottle (11) to the containing reservoir (21). The containing reservoir (21) defines a volume for containing a quantity of active substance which closes said passageway for the active substance.

19 Claims, 8 Drawing Sheets

24'
24'
24'
23
24

28
28
8
7
71
20
23
24'
21
D
L2
30'
30
25
R
10
11
13
12b
24
14
12

LIQUID ACTIVE SUBSTANCE DISPENSER FOR W.C. BOWL

TECHNICAL FIELD

This invention relates to a dispenser for liquid active substances (deodorants/cleansers/refreshers/disinfectants and the like) for a W.C. bowl.

BACKGROUND ART

It has been known for some time to use cage-like containers which are suspended below the rim of the W.C. bowl in a position such as to be struck by the flow of flushing water. An active cleansing and/or deodorant and/or air refreshing and/or disinfectant substance in solid block form is placed in the cage, to release its action on encountering the flushing water flow, and be diluted into it.

One defect is that the quantity of perfuming substance which can be incorporated as a component in the mixture which forms the solid block is relatively small, and moreover some components, and in particular this perfuming substance, are washed out by the water flow more quickly than others, with the result that their action does not have constant behaviour during the life of the block, but rapidly decreases to quickly disappear. Suitable containers for containing an active substance in the form of a gel are also known, having holes through which the water enters and leaves, entraining with it a part of the dissolved active substance.

EP 538957 describes a dispenser for a W.C. bowl comprising a bed of sponge material which is suspended below the bowl rim in a horizontal position, to be lapped by the flushing water flow, On this sponge bed a bottle containing liquid active substance is positioned inverted, with its mouth in contact with the sponge.

Other known solutions are illustrated in the patents EP878586, EP1046756 and WO01/04428, which do not use a sponge bed.

An object of this invention is to provide a device of the type to be housed within a W.C. bowl, comprising a bottle for containing active substance in the liquid state, and having an exit mouth for the active substance and a support means for supporting said bottle with its mouth facing downwards, in a position subjected to the action of the flushing water flow, which is different from known devices and is able to overcome the drawbacks arising in the operation of known devices, and in particular is able to effect a gauged and relatively regular delivery of the active substance from the bottle, so preventing wasteful substance loss.

Another object is to provide a dispenser which is of simple low-cost manufacture.

DISCLOSURE OF THE INVENTION

These and further objects are attained by the dispenser of the invention as characterised in the claims.

According to the invention, the support means comprises:

for containing the active substance, a reservoir located in a position subjected to the action of the flushing water flow and arranged to receive the mouth of the bottle, and a member positioned in said containing reservoir to close the mouth of the bottle; and, for the active substance, a passageway associated with said closure member to enable the active substance to pass from the internal chamber of the bottle to the containing reservoir;

said containing reservoir having about the bottle mouth a wall arranged to define a volume for containing a quantity of active substance which closes said passageway for the active substance.

According to a preferred embodiment the dispenser comprises at least one ventilation passageway which when in use connects the internal chamber of the bottle to atmospheric air, the dimensions of the ventilation passageway being related to the physical-chemical characteristics of the active substance so as to achieve a gauged passage of air towards the bottle interior such that the active substance does not normally leave the bottle, at least not to a relevant extent, whereas it leaves the bottle in a gauged manner when the flushing flow strikes the containing reservoir.

The invention is described in detail hereinafter with the aid of the accompanying figures, which illustrate one embodiment thereof by way of non-limiting example.

Figures 1, 6:
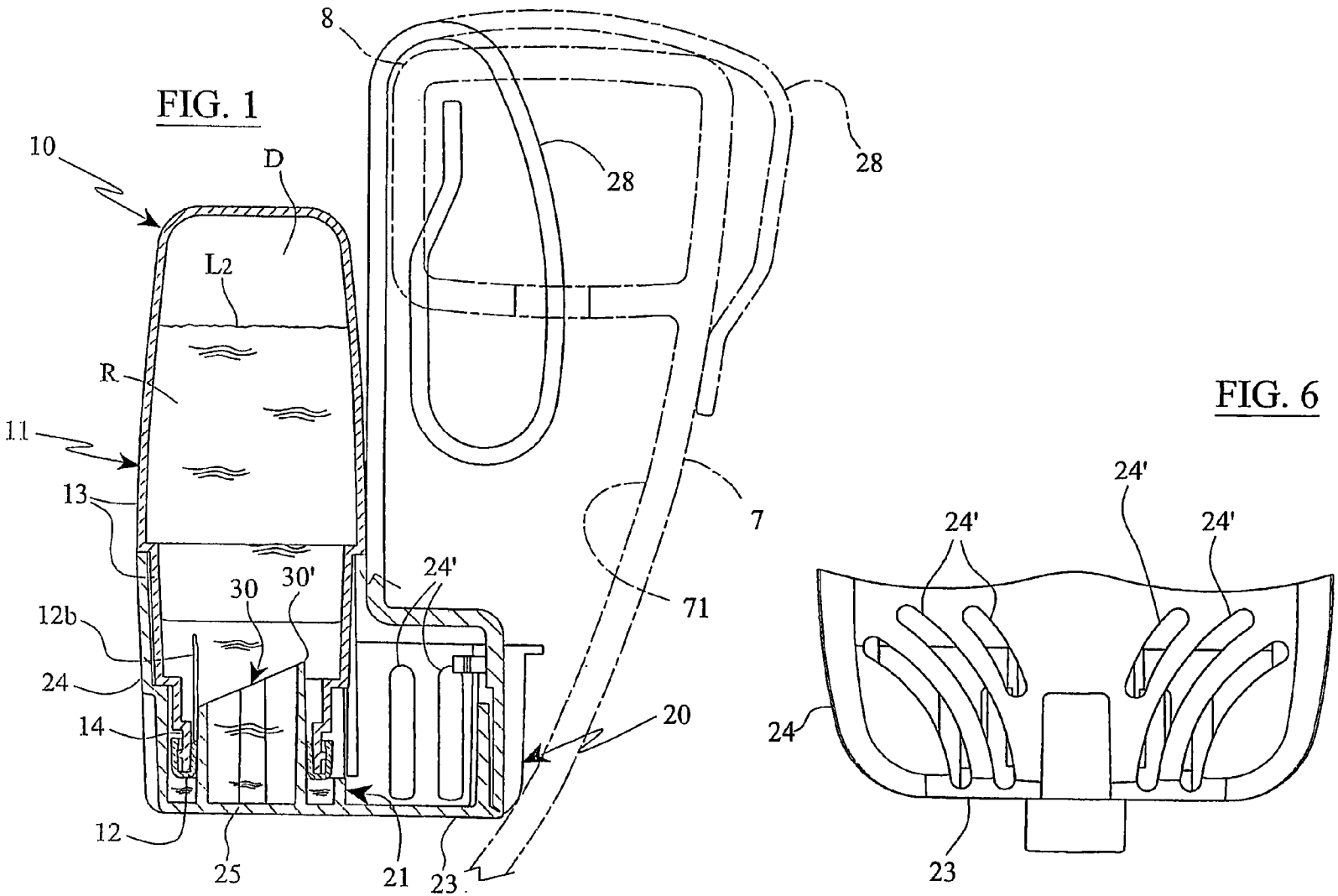
FIG. 1 is a view of a first embodiment of the dispenser of the invention taken on the vertical plane of symmetry I—I of FIG. 2
FIG. 6 is a front view of FIG. 1.

With reference to the first embodiment, shown in FIGS. 1–6, the dispenser of the invention (indicated overall by 10) comprises a bottle 11 for containing, in its internal chamber, an active deodorant/disinfectant substance R, i.e. able to cleanse and/or deodorize and/or air-refresh and/or disinfect, which is in the liquid (more or less viscous) state, and provided with an exit mouth 12 for the active substance R.

The dispenser 10 also comprises a support means 20 having a usual hooking means 28, in the form of a hook-shaped elongate element of elastically flexible material, by which it is hooked to the upper rim 8 of a W.C. bowl 7, and able to support said bottle 11 in an inverted position with its mouth 12 facing downwards, in a position subjected to the action of the flushing water flow.

The bottle 11 is separate from the support means 20 and is associated with it in order to be located in the W.C. bowl.

The entire dispenser 10, including the bottle 11, is to be housed within the W.C. bowl 7 against its inner surface 71, below its upper rim 8 and exposed to the action of the flushing water flow. Usually, the water flow emerges either along the rim 8 from holes provided in its lower part, or from a rear central mouth of the bowl and made to flow in a tangential direction along the inner surface 71, below the rim 8.

The support means 20 comprises, for containing the active substance, a reservoir 21 with an upwardly facing concavity located in a position subjected to the action of the flushing water flow and arranged to receive the mouth 12 of the bottle, and further comprises a member 30 positioned in said containing reservoir 21 to close the mouth of the bottle 11.

The containing reservoir 21 comprises a lower wall 25 having a closed surface 21*a*, on which the active substance collects, and a side wall 21*b* disposed about the mouth 12 of the bottle to define a volume for containing a quantity of substance.

Preferably, as shown in all the illustrated embodiments, said closure member 30 is in the form of an upwardly facing, substantially cylindrical or slightly frusto-conical tube piece coaxial with the bottle 11, its lower end being joined to the collection surface 21*a* of the containing reservoir 21 and being closed thereby. The tube piece 30 has an upper end 30' which projects upwards beyond the exit mouth 12 of the bottle associated with the support means 20, the exit mouth 12 being in geometrical relationship with the tube piece 30 such that its inner surface sealedly embraces the lateral surface of the tube piece 30.

According to the invention, with said closure member 30 there is associated a passageway 35 enabling the active substance R to pass from the internal chamber of the bottle 11 to the containing reservoir 21, the quantity of active substance collected by this latter being such as to close said passageway 35.

According to the first embodiment, shown in FIGS. 1–6, said passageway 35 for the active substance is defined by a gauged vertical corridor formed by a valley provided in the cross-section of the lateral surface of the tube piece 30, starting from a point within the chamber of the bottle 11 and terminating below the exit mouth 12 of the bottle 11; said corridor 35 extends along the entire height of the tube piece 30.

Preferably, the dispenser comprises at least one ventilation passageway 31 which, when in use, connects the internal chamber of the bottle 11 to atmosphere.

In the first embodiment, shown in FIGS. 1–6, the ventilation passageway 31 is defined by a gauged vertical corridor formed by an arched valley provided in the cross-section of the lateral surface of the tube piece 30, starting from a point below the exit mouth 12 of the bottle and terminating within the chamber of the bottle 11; said corridor 31 extends along the entire height of the tube piece 30.

Figure 2:
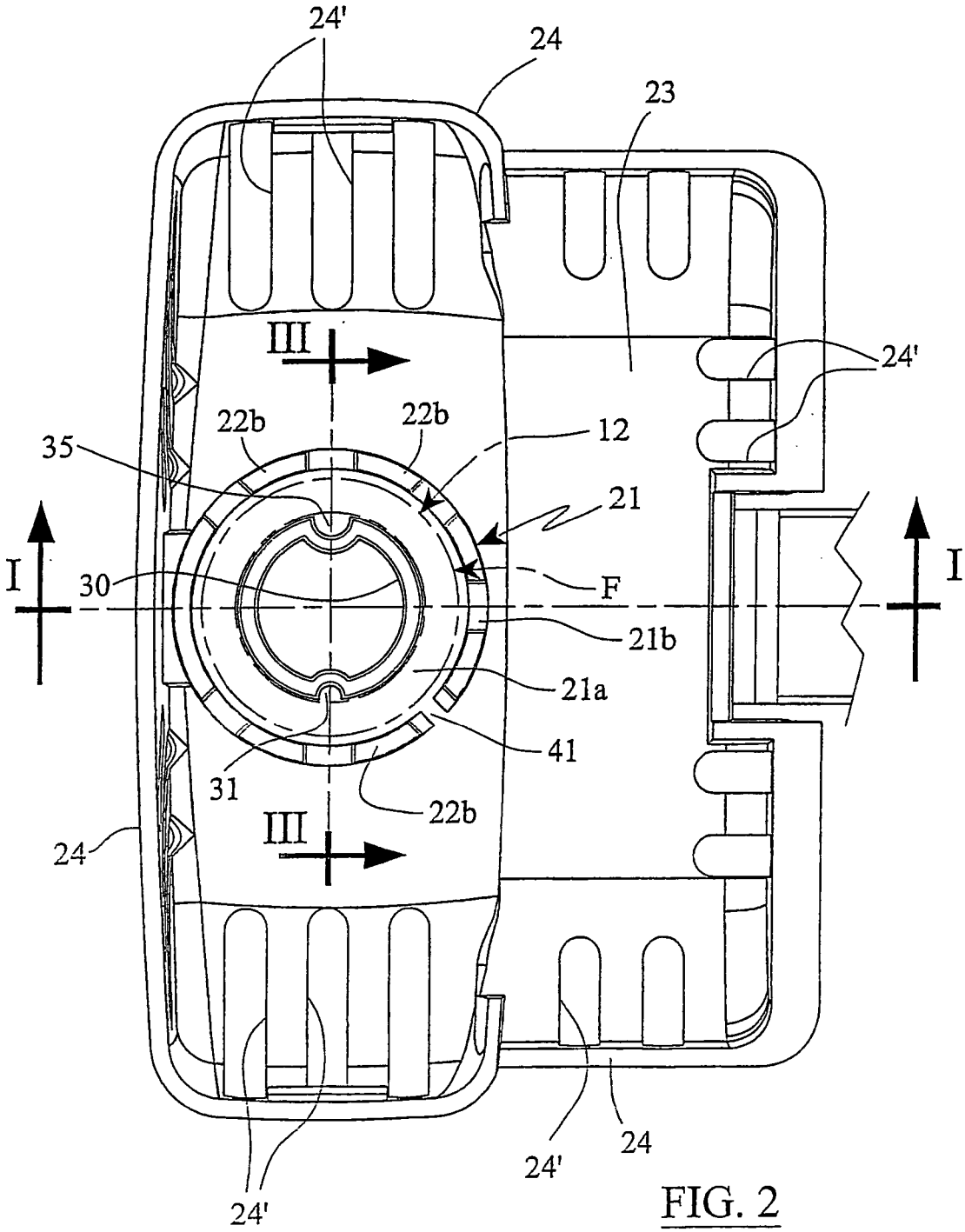
FIG. 2 is a top plan view of the support means of FIG. 1.

The corridor 31 is located in a geometrical position relatively far from the corridor 35 for the active substance, and in particular in a diametrically opposite position (see FIG. 2).

Figure 1A:
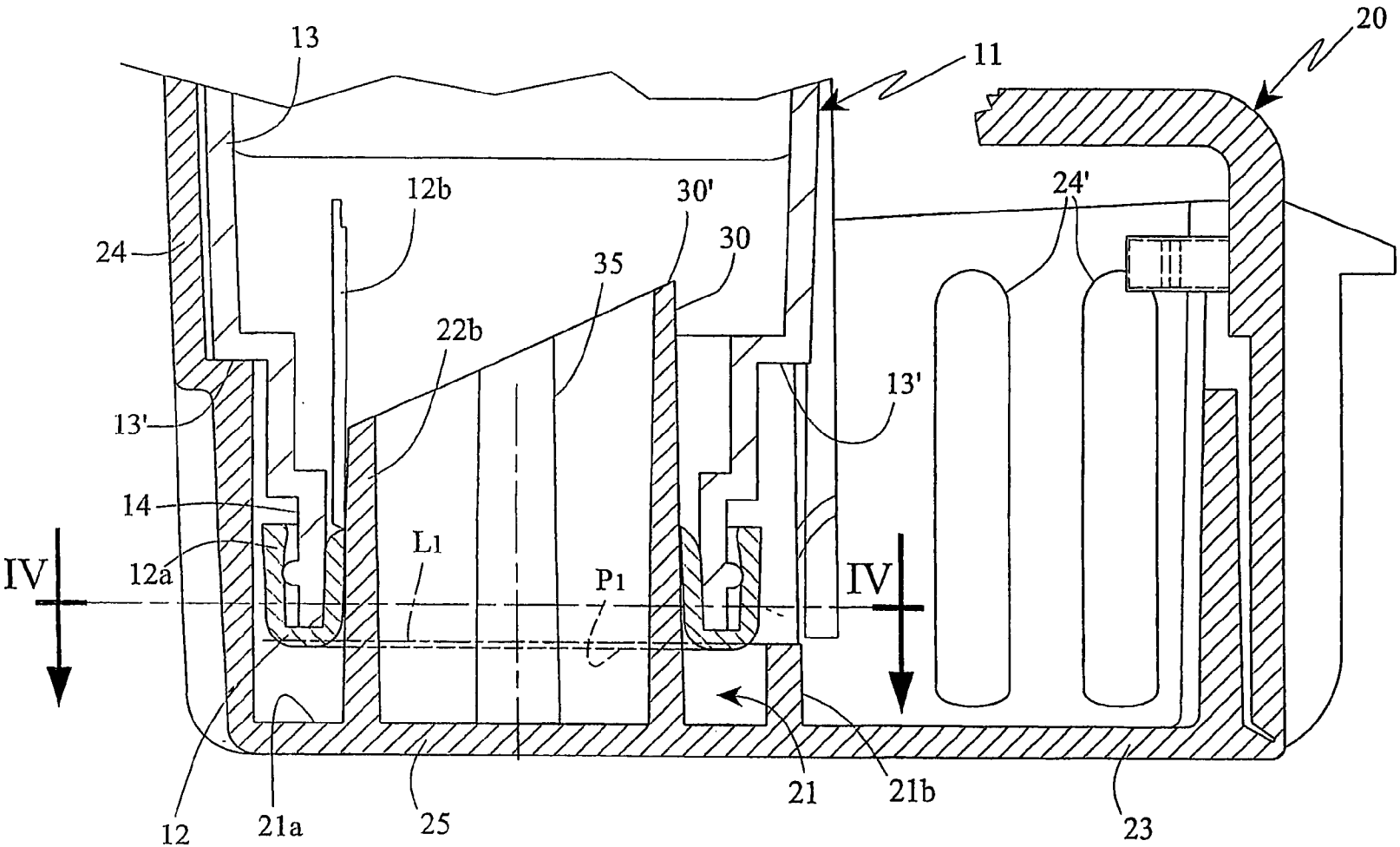
FIG. 1A is an enlarged detail of FIG. 1.
Figure 3:
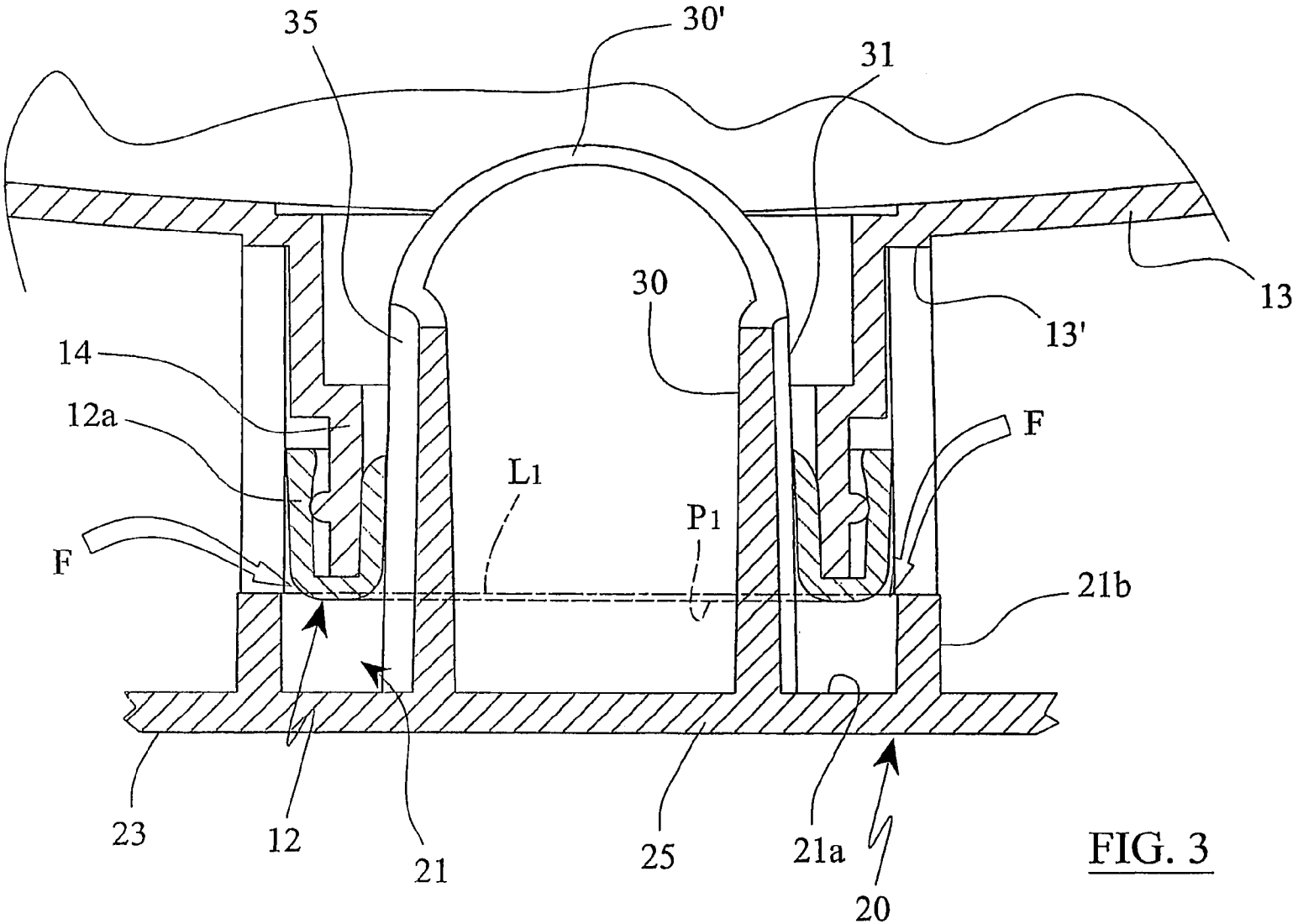
FIG. 3 is a section on the plane III—III of FIG. 2.
Figure 4:
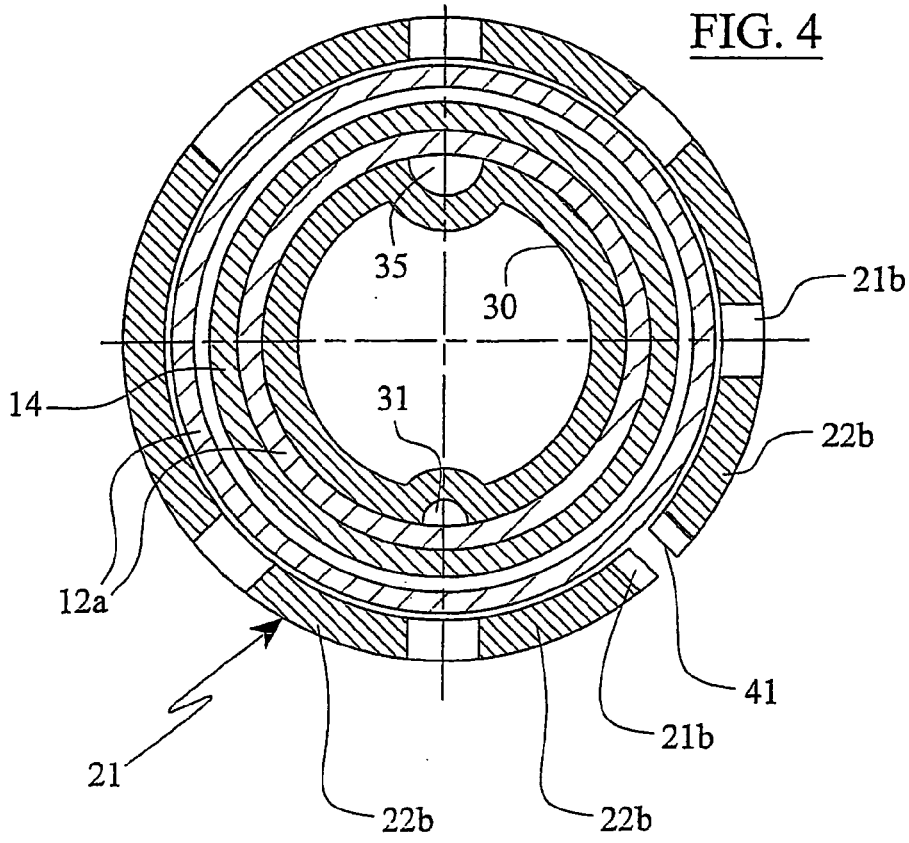
FIG. 4 is a section on the plane IV—IV of FIG. 1A.
Figure 5:
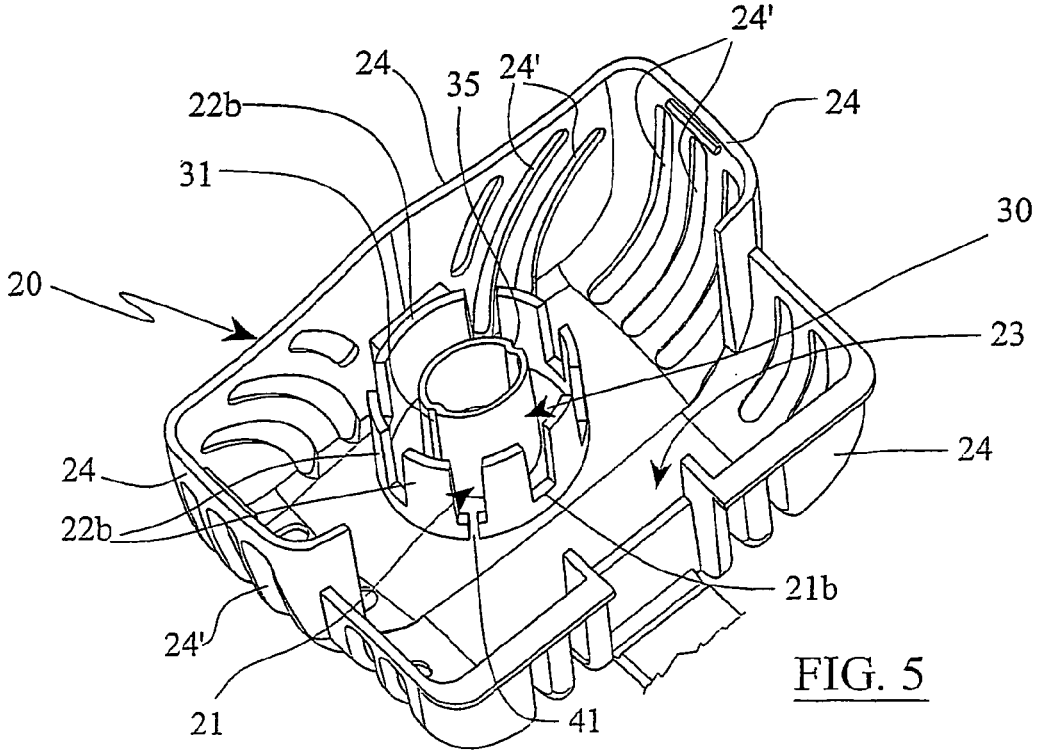
FIG. 5 is a perspective view of the support means of FIG. 1, without the bottle.

The reservoir 21 is arranged to contain a determined maximum level of liquid (indicated by L1 in FIGS. 1A and 3), and to contain the exit mouth 12 of the bottle 11, with its lower end passage section indicated by P1 in FIGS. 1A and 3 positioned below the maximum liquid level L1 to the side. In the illustrated first embodiment, said reservoir 21 is composed of the wall 25 defining the substantially flat, horizontal collection surface 21*a* and joined to the hooking means 28, and a substantially vertical, cylindrical side wall 21*b*, which extends totally about the exit mouth 12. The inner diameter of the side wall 21*b* is greater than the maximum outer diameter of the exit mouth 12, so that this can be contained within the side wall 21*b* at a small distance therefrom.

The upper end edge of the side wall 21*b* determines the maximum level L1 of the liquid which collects within the reservoir 21.

The side wall 21*b* possesses a number of wall extensions 22*b* in the form of crenellations, which project upwards beyond the upper edge of the wall 21*b* to define a resting means for the body 13 of the bottle 11 in order to position the bottle mouth 12 in a predetermined and precise geometrical relationship with the reservoir 21. The bottle 11 possesses a shoulder 13', from which there projects a cylindrical neck 14 carrying the mouth 12 at its end. The crenellations formed by the extensions 22*b* surround the mouth 12 and neck 14 of the bottle 11 when in an inverted position, to supportingly receive the shoulder 13' on their upper end edges; when in this position the mouth 12 is inserted into the reservoir 21, with its lower exit section P1 lying at a level less than the maximum level L1. In detail, the mouth 12 comprises an annular element 12*a* rigidly fixed to the end of the neck 14, to which there is joined a circular disc 12*b* for hermetically closing the passage port for the active substance R.

The lower end surface of the element 12*a* defines the lower end passage section P1. This section P1 lies a small distance from the upper edge of the lateral wall 21*b* of the reservoir 21, so that a narrow passageway (indicated by F) remains defined for the flushing water towards the concavity of the reservoir 21.

Specifically, the tube piece 30 is cut in an inclined manner to form an upper point 30' which projects upwards by an extent such as to penetrate through the mouth 12 of the bottle when placed in its position of use.

To dispose the bottle 11 in its position of use, it is inserted and pushed manually downwards to cause the tube piece 30 to penetrate into it so that the point of the tube detaches or tears the circular disc 12*b* from the annular element, to enable the active substance R present in the bottle 11 to descend through the exit mouth 12. The support means 20 together with the thus coupled bottle 11 is then placed in the W.C. bowl such that the collection surface 21*a* lies substantially horizontal or nearly so, and the flushing water fed into the W.C. bowl strikes the region in which the reservoir 21 lies.

The liquid substance R contained in the bottle 11 descends through the (open) mouth 12 and fills the internal closed space of the tube piece 30; this substance flows outwards only through the corridor 35, from which it descends into the reservoir 21 where it accumulates until it reaches or nearly reaches (but without exceeding it) the maximum level L1, at least in the region surrounding the lower mouth of the corridor 35.

Using an active substance R having a viscosity of $1000–3000\times10^{-2}$ P (poise), it has been found that if a sufficiently small ventilation passageway 31 is provided, the active substance R does not emerge from the passageway 31.

At this point, as the mouth 12 is hermetically closed, a vacuum environment forms in the upper part D of the internal chamber of the bottle 11 above the level of the active substance R, which in combination with the external atmospheric pressure and the weight of the substance contained in the bottle, reaches static equilibrium, without the substance R emerging from the bottle 11.

When a flush is activated, the flushing water penetrates into the reservoir 21 through the gap F and carries away a small quantity of the substance R contained in the reservoir 21, to dilute it and release its deodorant/cleansing/refreshing/disinfectant action.

It has been observed experimentally that when a part of the active substance is carried away, this, probably together with the turbulence produced by the flush, causes a little ventilation air to enter the bottle 11 through the passageway 31 and reach the upper part D. This changes the equilibrium between the pressure in the bottle and the external pressure in the reservoir 21, to cause a gauged descent of the level L2, corresponding to one measure of active substance R, with consequent restoration of the level L1 in the reservoir 21.

For this to happen, the geometrical characteristics of the ventilation passageway 31 are in relation to the physical-chemical characteristics of the active substance R (in particular to its viscosity) in order to achieve a gauged passage of air into the bottle 11, such that the active substance normally does not emerge from the bottle 11, at least to a relevant extent, whereas it leaves in a gauged manner from the bottle 11 when the flushing water flow strikes the containing reservoir 21.

Excellent results are obtained with a dispenser in which the cross-section of the ventilation passageway 31 has an area of 3–6 $mm^2$ when the active substance has a viscosity of $1600–2400\times10^{-2}$ P (poise).

Moreover, preferably, the distance of the lower section P1 from the collection surface 21*a* is relatively small, equal to a few millimeters, the distance between the maximum level L1 of the reservoir 21 and the lower section P1 of the mouth 12 being even less. It has been observed that these characteristics can also influence regular ventilation of the bottle 11 through the passageway 31.

To facilitate the washing-away and removal of the active substance R by the water flow, the support means 20 comprises a horizontal platform 23 which surrounds the collection surface 21*a* of the reservoir 21 and is surrounded in its turn by a vertical wall 24 which defines a relatively wide basin, provided with numerous wide apertures 24' for passage of the water, which surrounds the containing reservoir 21 and the lower portion of the inverted bottle 11.

It has been observed that under certain circumstances a problem can arise, namely that at each flush of water, a little water remains inside the reservoir 21 to replace that part of the active substance R which was carried away, and that as the number of flushes increases the active substance R contained in the bottle 11 becomes increasingly diluted as the level L2 in the bottle falls, until its percentage is excessively low compared with the water. This is obviously unacceptable as the positive action of the active substance gradually falls in intensity as the number of water flushes increases.

This problem is avoided by providing, in the containing reservoir 21, at least one drainage aperture 41 of gauged passage size such as to enable water to pass while preventing passage of the active substance. In the first embodiment, a drainage aperture 41 in the form of a vertical slot is provided in the side wall 21*b* of the containing reservoir 21, preferably along its entire height, and having a width of 0.5–2.5 mm in the case of an active substance R of viscosity $1600–2400\times10^{-2}$ P (poise). Preferably the slot 41 is positioned a large distance from the passageway 35 for the active substance, in particular close to the ventilation corridor 31.

In this case, it has been observed that after the flushing water has at least partly struck and washed away the contents of the reservoir 21, it drains through the slot 42 together with the more diluted active substance part, leaving inside the reservoir 21 only the more viscous active substance part.

Alternatively, one or more drainage apertures, for example in the form of through holes, can be provided in the collection surface 21*a* of the containing reservoir 21.

In certain cases, especially with an active substance having a relatively high viscosity and with a water drainage aperture located in a position relatively distant from the passageway for the active substance, it has been observed that the active substance contained in the reservoir 21 falls in level starting from the maximum level point L1, located in correspondence with the passageway 35, until it becomes practically zero in correspondence with the aperture 41, with the result that the active substance 41 does not emerge from the aperture 41 even if this has a large width.

Figure 7:
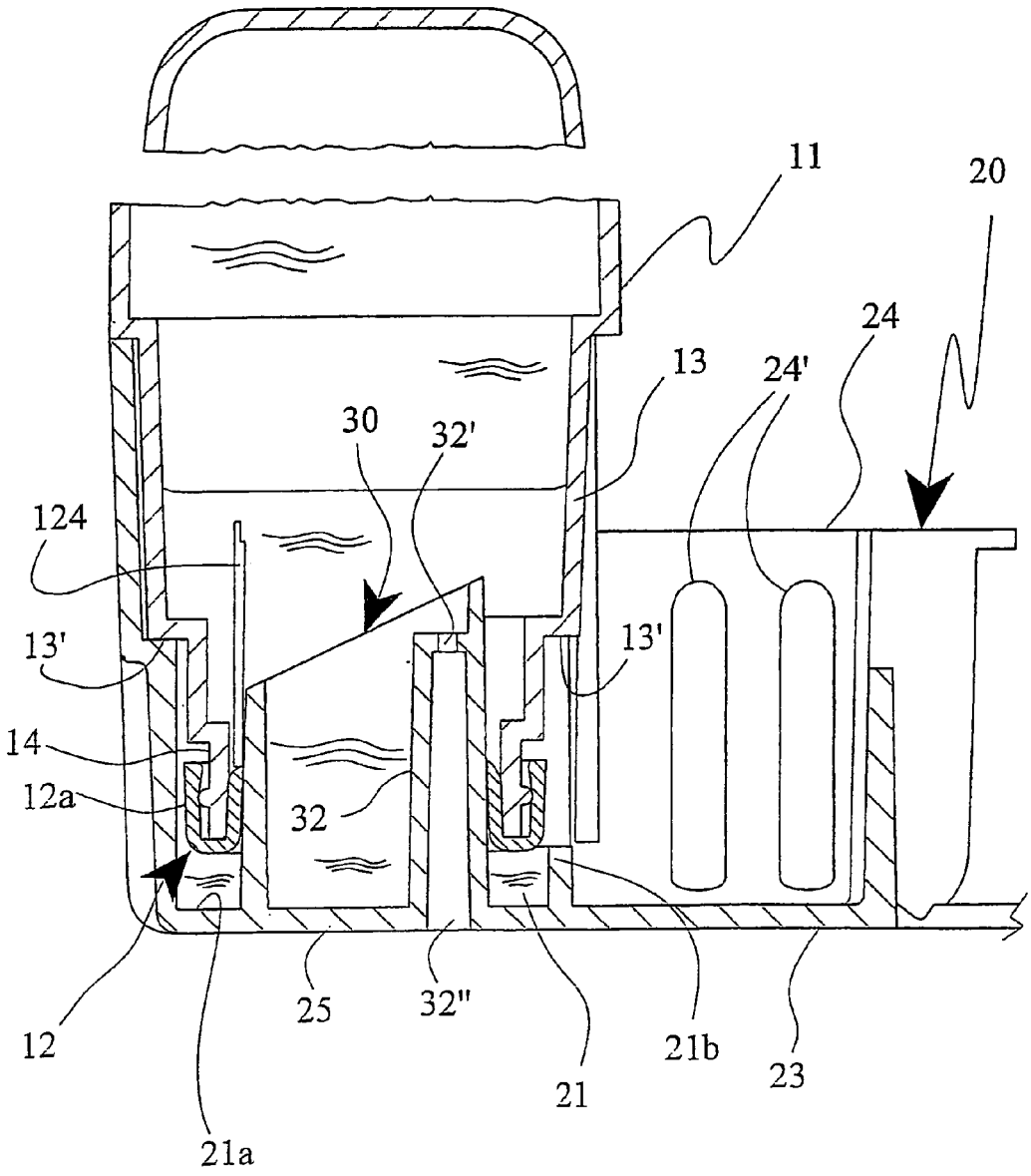
FIG. 7 is a section on the vertical plane of symmetry VIII—VIII of FIG. 8 through a second embodiment of the dispenser of the invention.
Figure 8:
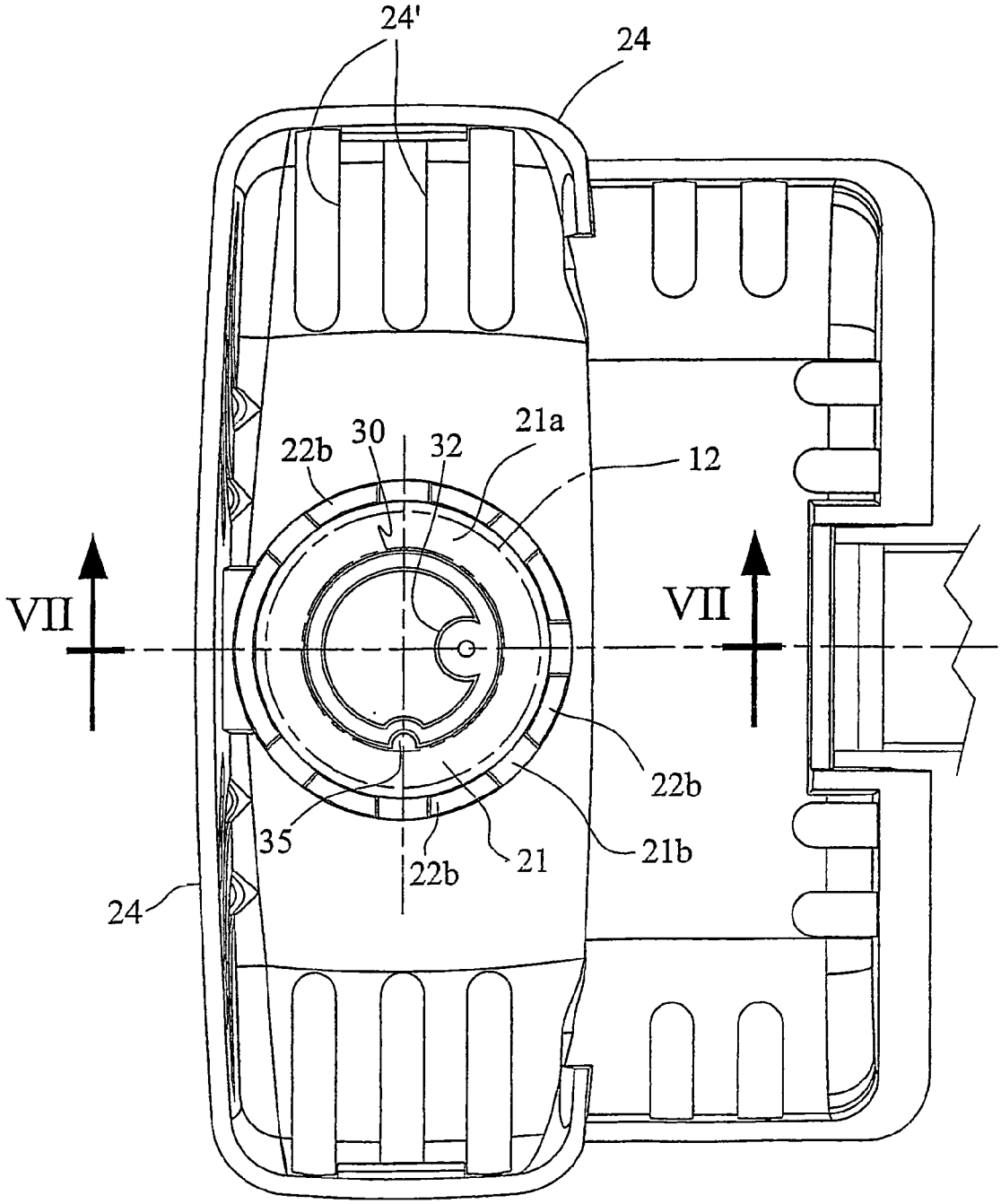
FIG. 8 is a top plan view of the support means of FIG. 7.

FIGS. 7 and 8 show a second embodiment of the invention, which has also given excellent experimental results.

This embodiment differs from the preceding only with regard to the ventilation passageway 35. This comprises a thin tubular ventilation conduit 32 positioned within the tube piece 30 to communicate with the air below the lower wall 25 of the containing reservoir 21 and projecting upwards towards and through the mouth 12 of the bottle 11. The tubular conduit 32 has a circular cross-section and is fixed to the lower wall 25 to rise vertically from it, in a position in the interior of the tube piece 30.

Preferably the lower end passage opening 32" of the conduit 32 is greater than its upper end passage opening 32'.

With this type of dispenser excellent behaviour has been observed even without the water drainage aperture 41.

The geometrical characteristics of the ventilation passageway 31, in relation to the viscosity of the active substance R, are determined such that:

- the quantity of ventilation air entering the bottle 11 is sufficient, after each flush (or after a small number of flushes), to cause the upper level L2, by virtue of the pressure increase produced inside the bottle, to descend by an amount corresponding to the measure of substance R released into the water flow,
- while at the same time a vacuum level remains inside the bottle which is able to prevent the substance R from overflowing out of the reservoir 21.

Preferably, in the ventilation conduit 31, the diameter of the lower end passage opening is greater than the upper end passage opening. Excellent results are obtained with dispensers in which:

- the lower end opening 32" has a diameter between 3.5 mm and 5 mm,
- the upper end opening 32' has a diameter between 0.3 mm and 1.5 mm,
- said conduit 32 projects upwards for a length of 5–15 mm,
- if the active substance has a viscosity between $1600–2400\times10^{-2}$ P (poise).

In this respect it has been experimentally observed that after each water flush (or after a small number of flushes), a small number of air bubbles penetrate from the outside to the inside of the bottle 11 through the ventilation conduit 32, to influence its pressure and give rise, during operation, to regular emission of the active substance R at each water flush, the active substance R contained inside the bottle 11 maintaining its active characteristics (deodorant/cleansing/refresh ing/disinfectant and the like) substantially constant or nearly constant with time for a relatively large number of flushes (up to 250–450 flushes with 50–55 ml of active substance), and not mixing with the water other than to a relatively small extent at the end of its life.

As an alternative to the tubular conduit 32, said ventilation passageway can consist of a through aperture, in the form of a hole, provided in the lower wall 25 of the containing reservoir 21 in a position facing the bottle mouth (not shown in the figures). Excellent results have been obtained where said through aperture has a diameter between 1 mm and 2 mm for an active substance viscosity of $1600–2400\times10^{-2}$ P poise).

Figure 9:
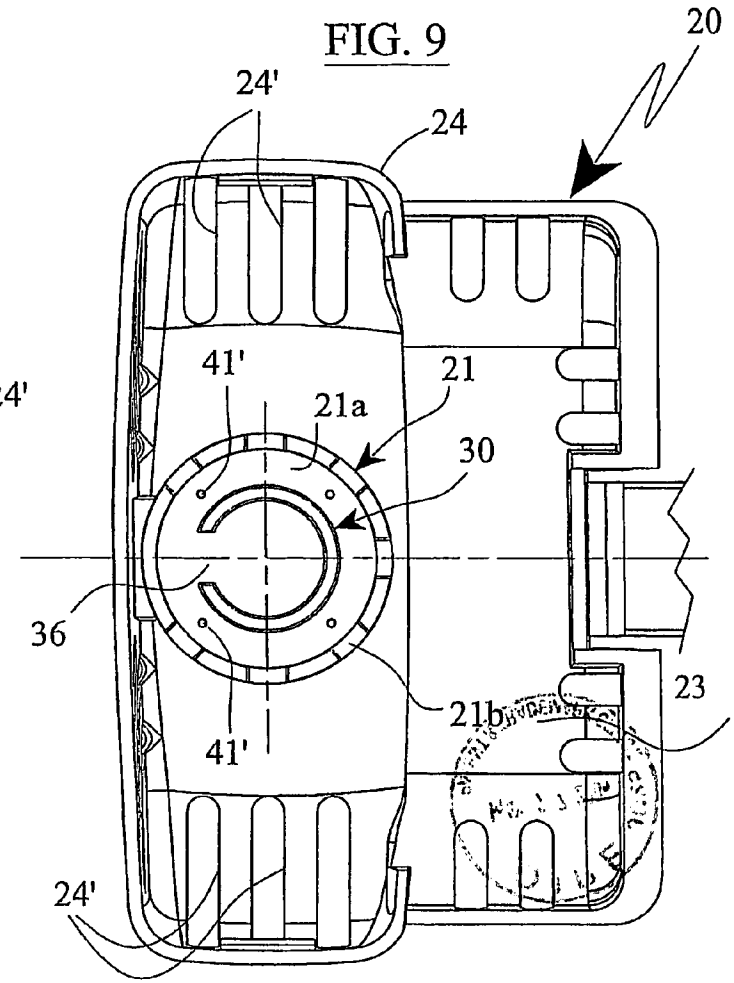
FIG. 9 is a top plan view of the support means of a third embodiment of the dispenser of the invention.
Figure 10:
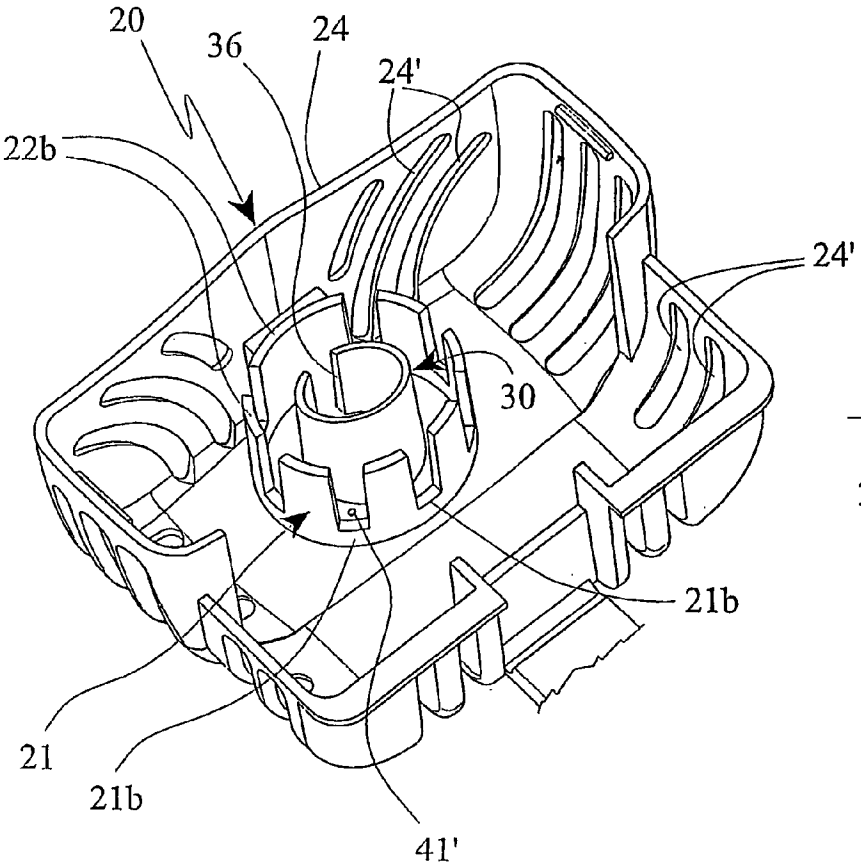
FIG. 10 is a perspective view of FIG. 9.

In the embodiment shown in FIGS. 9 and 10, the passageway for the active substance from the bottle 11 to the reservoir 21 is defined by a vertical through slot passing through the wall of the tube piece 30 and starting from a point in the interior of the chamber of the bottle 11, to terminate below the exit mouth 12, this enabling the active substance R to flow to the outside from the interior of the tube piece 30. The slot 36 extends along the entire height of the side wall of the tube piece 30.

The ventilation passageway could also be dispensed with. In this case the aforestated problem of excessive dilution of the active substance is solved by providing the reservoir 21 with at least one discharge aperture, in the form of a through hole 41' the passage opening of which is sized on the basis of the viscosity of the active substance R, to enable water to pass but to prevent passage of the active substance R.

One or more of said discharge holes 41' are located in the collection surface 21*a* of the reservoir 21, in particular in that region external to the tube piece 30.

As an alternative to the discharge holes 41', or in combination therewith, a vertical slot can be provided in the side wall 21*b* of the reservoir (such as that already described with reference to the first embodiment), to preferably extend along the entire height of the wall 21*b* and having a width such as to enable water to drain but to prevent passage of the active substance R in that this has a greater viscosity.

By virtue of the apertures 41' and/or of said slot, the flush water which tends to collect in the reservoir 21 is effectively drained off, so preventing or at least delaying the dilution of the active substance with time. In other words, a good dispenser life is ensured together with good constancy of the active characteristics (deodorant/cleansing/refreshing/disinfectant and the like) of the substance as the number of flushes progresses.

The presence of holes 41' in the base of the reservoir 21 is preferred if the active substance R has a specific gravity density than water, in that in this case the water tends to gather close to the base of the reservoir 21; in contrast, the slot in the side wall 21*b* is preferred if the active substance R has a higher specific gravity than water, in that in this case the water tends to remain on top and hence to drain from the upper part of the slot.

Numerous modifications of a practical and applicational nature can be made to the invention, but without leaving the scope of the inventive idea as claimed below.

What is claimed is:

1. A liquid active substance dispenser for a W.C. bowl, to be housed within the W.C. bowl, comprising a bottle (11) for containing the active substance (R) in the liquid state and provided with an exit mouth (12) for the active substance (R), and a support means (20) for supporting said bottle (11) in an inverted position, with its mouth (12) facing downwards, in a position subjected to the action of the flushing water flow, said bottle (11) being separate from the support means (20), the support means (20) comprising, for containing the active substance, a reservoir (21) located in a position subjected to the action of the flushing water flow and arranged to receive the mouth (12) of the bottle, characterized in that the support means (20) comprises a member (30) positioned in said containing reservoir (21) to close the mouth (12) of the bottle (11); and for the active substance, at least one passageway associated with said closure member (30) to enable the active substance to pass from the internal chamber of the bottle (11) to the containing reservoir (21), said containing reservoir (21) comprising a passageway (F) for the flushing water entering the concavity of the reservoir (21) and defining a volume for containing the mouth (12) of the bottle (11) and a quantity of active substance whose maximum level (L1) is at a upper level than the lower exit section (P1) of the mouth (12) so that it closes said passageway for the active substance.

2. The dispenser as claimed in claim 1, characterized by comprising at least one ventilation passageway (31 and 32) which, when in use, connects the internal chamber of the bottle (11) to atmosphere.

3. The dispenser as claimed in claim 1, characterized in that the geometrical characteristics of the ventilation passageway (31, 32) are in relation to the physical-chemical characteristics of the active substance so as to achieve a gauged passage of air into the interior of the bottle (11) such that the active substance does not normally leave the bottle (11), at least not to a relevant extent, whereas it leaves the bottle (11) in a gauged manner when the flushing flow strikes the containing reservoir (21).

4. The dispenser as claimed in claim 3, characterized in that said closure member (30) is in the form of an upwardly facing tube piece closed lowerly by the collection surface (21*a*) of the containing reservoir (21) and having an upper end which projects upwards beyond the exit mouth (12) of the bottle associated with the support means (20), the exit mouth (12) being in such geometrical relationship with said member (30) as to sealedly embraces its lateral surface.

5. The dispenser as claimed in claim 4, characterized in that the passageway for the active substance is defined by a gauged vertical corridor (35) provided in the lateral surface of the closure member (30) and starting from a point in the interior of the chamber of the bottle (11), to terminate below the exit mouth (12).

6. The dispenser as claimed in claim 4, characterized in that the passageway for the active substance is defined by a through slot (36) passing through the wall of the tube piece (30) and starting from a point in the interior of the chamber of the bottle (11), to terminate below the exit mouth (12).

7. The dispenser as claimed in claim 4, characterized in that said ventilation passageway comprises a ventilation conduit (32) positioned within said tube piece (30) to communicate with the air below the lower wall (25) of the containing reservoir (21) and projecting upwards towards the mouth (12) of the bottle.

8. The dispenser as claimed in claim 7, characterized in that the lower end passage opening (32") of the ventilation conduit (32) is larger than the upper end passage opening (32') thereof.

9. The dispenser as claimed in claim 8, characterized in that said lower end opening (32") has a diameter between 3.5 mm and 5 mm and said upper end opening (32') has a diameter between 0.3 mm and 1.5 mm when the active substance has a viscosity of $1600–2400\times10^{-2}$ P (poise).

10. The dispenser as claimed in claim 7, characterized in that said tubular conduit (32) projects upwards for a length of 5–15 mm when the active substance has a viscosity of $1600–2400\times10^{-2}$ P (poise).

11. The dispenser as claimed in claim 3, characterized in that said ventilation passageway comprises a through aperture located in the lower wall (25) of the containing reservoir (21), in a position facing the mouth of the bottle (11).

12. The dispenser as claimed in claim 11, characterized in that said through aperture has a diameter between 1 and 2 mm when the active substance has a viscosity of $1600–2400\times10^{-2}$ P (poise).

13. The dispenser as claimed in claim 1, characterized in that the ventilation passageway is defined by a gauged vertical corridor (31) provided in the lateral surface of the closure member (30) and starting from a point below the exit mouth (12), to terminate in the interior of the chamber of the bottle (11).

14. The dispenser as claimed in claim 13, characterized in that the cross-section of the ventilation passageway (31) has an area of 3–6 $mm^2$ when the active substance has a viscosity of $1600–2400\times10^{-2}$ P (poise).

15. The dispenser as claimed in claim 1, characterized in that said containing reservoir (21) has an upward facing concavity positioned in the region subjected to the water flow and arranged to contain a determined maximum level of liquid, and to contain the exit mouth 12 of the bottle with its lower end passage section (P1) positioned below the maximum level (L1) of liquid present in the reservoir (21).

16. The dispenser as claimed in claim 1, characterized in that said containing reservoir (21) comprises at least one drainage aperture (41, 41') having a passage opening sized such as to enable water to pass but to prevent passage of the active substance.

17. The dispenser as claimed in claim 16, characterized in that said drainage aperture is in the form of a vertical slot (41) provided in the side wall **(21*b*) of the containing reservoir (21)**.

18. The dispenser as claimed in claim 16, characterized in that one or more of said drainage apertures (41') are located in the collection surface **(21*a*) of the containing reservoir (21)**.

19. The dispenser as claimed in claim 1, characterized in that said containing reservoir (21) comprises at least one water drainage aperture (41) located in a position relatively distant from the active substance passageway (35) in relation to the viscosity of the active substance, such that this does not emerge to a relevant extent from the aperture (41).

* * * * *